United States Patent [19]

Rajakallio et al.

[11] Patent Number: 4,676,322

[45] Date of Patent: Jun. 30, 1987

[54] SUPPORTING ARRANGEMENT FOR A FEED DEVICE FOR A ROCK DRILLING MACHINE

[75] Inventors: Pauli Rajakallio; Leo Häkinen, both of Tampere, Finland

[73] Assignee: Oy Tampella AB, Tampere, Finland

[21] Appl. No.: 645,087

[22] Filed: Aug. 28, 1984

[30] Foreign Application Priority Data

Sep. 20, 1983 [FI] Finland ..... 833368

[51] Int. Cl.[4] ..... E21C 11/00

[52] U.S. Cl. ..... 173/36; 173/32; 173/34

[58] Field of Search ..... 173/31–33, 173/36, 34

[56] References Cited

U.S. PATENT DOCUMENTS

| | | | |
|---|---|---|---|
| 2,840,347 | 6/1958 | Feucht | 173/36 |
| 2,886,290 | 5/1959 | Brennan et al. | 173/34 |
| 3,057,416 | 10/1962 | Carlson et al. | 173/34 |
| 3,399,734 | 9/1968 | Folinsbee | 173/34 |
| 3,951,216 | 4/1976 | Crawshay et al. | 173/32 |

*Primary Examiner*—Donald R. Schran
*Assistant Examiner*—James L. Wolfe
*Attorney, Agent, or Firm*—Ladas & Parry

[57] ABSTRACT

A supporting arrangement for a feed device for a drilling machine of a rock drilling unit (2) comprising a feed device (3) for a drilling machine (4), a cradle (5) supporting the feed device longitudinally displaceably and a supporting device (10) which is extendable in parallel with the feed device for supporting the feed device against a tunnel wall. The supporting device is supported by the cradle so that it remains stationary with respect to the cradle when the feed device is displaced.

11 Claims, 6 Drawing Figures

Figure 6:
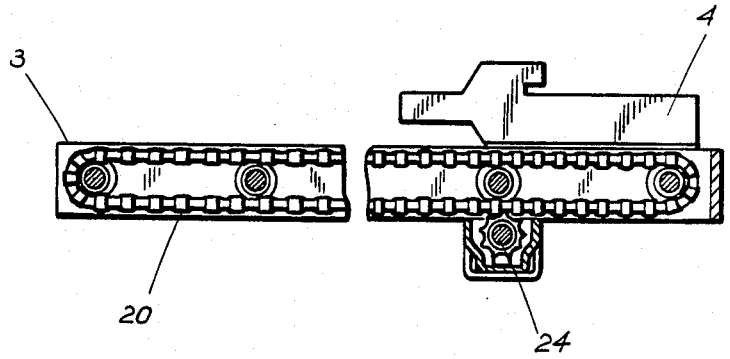

FIG. 1
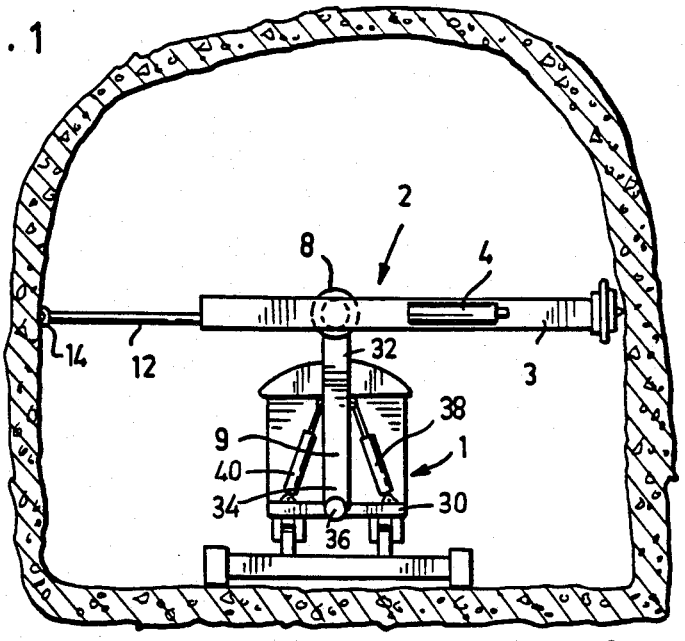
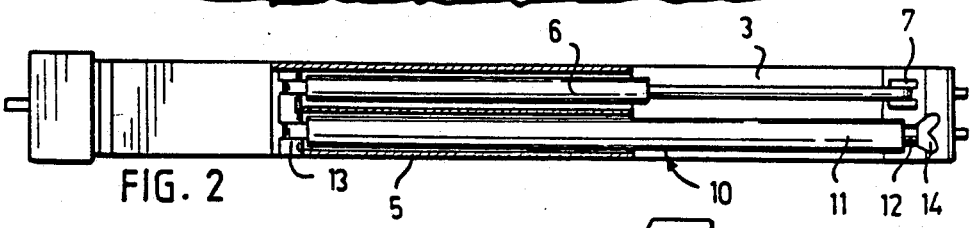
FIG. 2
FIG. 3
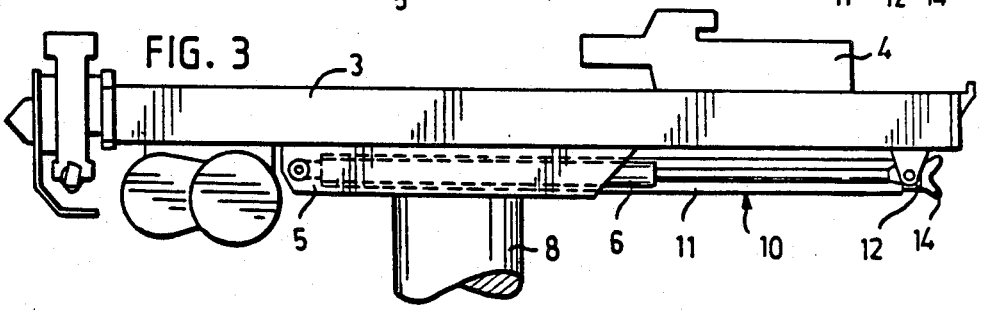
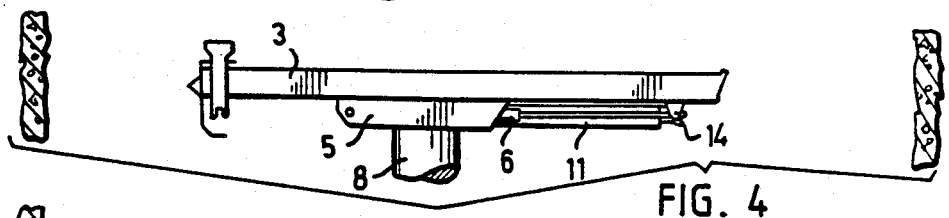
FIG. 4
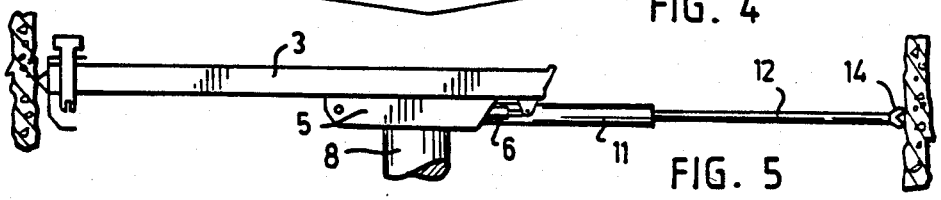
FIG. 5

SUPPORTING ARRANGEMENT FOR A FEED DEVICE FOR A ROCK DRILLING MACHINE

The present invention relates to a supporting arrangement for a feed device for a drilling machine of a rock drilling unit comprising a feed device for a drilling machine, a cradle supporting the feed device longitudinally displaceably, and a supporting device which is extendable in parallel with the feed device for supporting the feed device against a tunnel wall.

Such a drilling unit is used when drilling rock tunnels, whereby the feed device is supported between the tunnel walls by pushing the front end of the feed device with respect to the cradle supporting the device in contact with the tunnel wall by means of a displacing cylinder attached to the cradle, after which the rear end of the feed device is supported against the opposite wall of the tunnel by means of a supporting device which can be extended by pressure medium operated means.

In known rock drilling units provided with such a supporting arrangement said supporting device is attached to the rear end of the feed device in order to move with the feed device when the feed device is displaced with respect to the cradle. Such a supporting arrangement, however, has the drawback that the reach of the supporting device from the cradle changes depending on the movement of the feed device because the supporting device is displaced together with the feed device. Because of this the supporting device moves away from the opposite tunnel wall more and more as the front end of the feed device is displaced forwards in contact with the other tunnel wall. Consequently the length of the feed device must not be much shorter than the width of the tunnel which complicates the manaeuvering of the feed device in the tunnel. A further drawback is that the supporting force obtained by the supporting device is essentially eccentric as regards the force caused by the drill rod because the supporting device has to be attached outside the feed device.

The object of the present invention is to provide a supporting arrangement eliminating said drawbacks and enabling efficient supporting of the feed device against the tunnel walls also in wide tunnels. This object is achieved with a supporting arrangement according to the invention, which is characterized in that the supporting device is supported by the cradle.

The invention is based on the idea that the supporting device is arranged on such a constructional element of the rock drilling unit which does not move together with the feed device when displacing the feed device forwards in contact with one wall of the tunnel. Thus the reach of the supporting device from the cradle towards the opposite tunnel wall remains unchanged and the reach is as much bigger as one stroke length of the displacing cylinder of the feed device compared with known arrangements, so that the supporting device in the extended position obtains a reliable abutting contact with the opposite wall also in tunnels where the tunnel width is essentially bigger than the length of the feed device. Furthermore, the line of support of the supporting device can be located essentially in the centre of the feed device.

The invention is described in more detail in the following with references to the enclosed drawings, wherein FIG. 1 is a schematical view of a drilling unit provided with a supporting arrangement according to the invention seen in the direction of the tunnel when the feed device is supported between the tunnel walls, FIGS. 2 and 3 are, on a larger scale, views of the feed device seen from two different directions, FIGS. 4 and 5 are schematical views of the supporting arrangement in two different positions of the feed device; and FIG. 6 is a view showing a feed chain for displacement of the drilling machine within the feed device.

In the drilling unit shown in FIGS. 1–3 of the drawings a transportation base 1 supports a rod drilling unit 2 having an elongated feed device 3. A drilling machine 4 is displaceable along the elongated feed device 3. This feature is known in the prior art from U.S. Pat. No. 2,365,749 issued on Dec. 26, 1944 to Curtis (the patent) which is hereby incorporated by reference.

The Patent discloses (see FIG. 6 of the application) that the drilling machine 4 is displaceable within the feed device 3 by means of the feed chain 20 which extends substantially parallel to the upper and lower walls of the feed device. The feed chain is driven by a sprocket 24 which is fixed to a shaft of a motor (not shown). The feed device is mounted on a cradle 5 so that the feed device can move in the longitudinal direction with respect to the cradle. A hydraulic cylinder 6 acting as displacing means is mounted on the cradle. The cylinder is at one end pivoted to the cradle and the piston rod is pivoted to a protruding part 7 at the rear end of the feed device. The cradle is supported by a rotation axle 8 which is mounted on a swinging arm 9 of the transportation base 30.

The rock drilling unit is further provided with a supporting device 10 by which the rear end of the feed device is supported against the opposite wall of the tunnel in the manner shown in FIG. 1. The supporting device is according to the invention mounted on the cradle 5, as best appears from FIGS. 2 and 3.

A hydraulic support cylinder 11 provided with a supporting bar 12 operates as a supporting device. The cylinder is pivoted at one end to the cradle at a point 13 so that the opposite end of the cylinder and a support 14 of the supporting bar 12 retracted into the cylinder are positioned essentially at the rear end of the feed device when the feed device is retracted to the position shown in FIGS. 2 and 3. The supporting device is positioned almost in the centre of the feed device.

It is observed that in the supporting arrangement according to the invention the supporting device does not move with the feed device but remains in place with respect to the cradle so that the distance of the support 14 from the opposite tunnel wall remains unchanged when the feed device is displaced forwards from the retracted transport position shown in FIG. 4 to the protruding supporting position shown in FIG. 5. Because of this the support 14 extends into supporting contact with the tunnel wall, even if the tunnel width is considerably bigger than the length of the feed device. The supporting force obtained by the supporting device acts essentially centrally with respect to the force caused by the drill rod.

It is shown in FIG. 1 that the arm 9 has a first end 32 and a second end 34. The axle 8 is received by the first end 32 of the arm. The arm 9 is pivotably movable about an axis of a pivot 36 by at least one moving means 38 or 40. The axis of the pivot is substantially parallel to the axis of the axle 8. The transportation base means 30 is movable along its longitudinal axis which is substantially parallel to the axis of the pivot.

We claim:

1. A supporting arrangement for a feeding device of a rock drilling unit comprising a drilling machine displaceable along and supported by the feeding device;

support means comprising a piston-cylinder arrangement and a cradle means for supporting the feeding device longitudinally and displaceably, said piston-cylinder arrangement being at one end attached to the cradle and at another end attached to said feeding device, said support means connected to axle means for mutual rotation about a longitudinal axis of said axle means, an arm having a first and a second ends, said axle means received by the first end of the arm;

a supporting device comprising a pressure operated support cylinder provided with a displaceably supporting arrangement, the supporting arrangement is displaceable to form substantially an extension of a rear end of the feed device in the direction substantially parallel to a longitudinal axis of the feeding device for supporting of the feeding device against tunnel walls, the supporting device being supported by said support means, the supporting device being attached only to said cradle at one end in a such manner that the position of the supporting device is independent of the position of the feeding device regarding said support means.

2. A supporting arrangement according to claim 1 wherein at least a portion of the support cylinder of the supporting device is fastened to said support means and being parallel to the feed device.

3. A supporting arrangement according to claim 2 wherein the supporting arrangement of the support cylinder is arranged essentially in the center of the feed device.

4. A supporting arrangement according to claim 1 wherein an end of the supporting arrangement to be pressed against the tunnel wall is positioned at a rear end of the feed device when the feed device is positioned in its retracted position with respect to said support means.

5. A supporting arrangement according to claim 1 wherein the arm is pivotably attached to base means at the second end of the arm.

6. A supporting arrangement according to claim 5 wherein the arm is pivotably movable about an axis of a pivot by at least one moving means, said axis of the pivot is substantially parallel to the axis of said axle means.

7. A supporting arrangement according to claim 5 wherein said base means is movable along its longitudinal axis which is substantially parallel to the axis of the pivot.

8. A supporting arrangement according to claim 1 wherein said support means is fixedly attached to said axle means and said axle means is rotatable within the arm.

9. A supporting arrangement according to claim 1 wherein the longitudinal axis of the feeding device and the longitudinal axis of said axle means are positioned within the planes substantially perpendicular to each other.

10. A supporting arrangement according to claim 1 wherein the supporting device is attached to said support means.

11. A support arrangement according to claim 1 wherein the supporting device maintains its maximum support extension outwardly from said support means when the feeding device is displaced in the opposite direction to its outmost position regarding said support means.

* * * * *

UNITED STATES PATENT AND TRADEMARK OFFICE

CERTIFICATE OF CORRECTION

PATENT NO. : 4,676,322

DATED : June 30, 1987

INVENTOR(S) : RAJAKALLIO, Pauli et al

It is certified that error appears in the above-identified patent and that said Letters Patent is hereby corrected as shown below:

Title Page, Item [75] Inventors:

delete "Hakinen" and replace therefor

-- Hakkinen --.

Signed and Sealed this

Fifteenth Day of December, 1987

*Attest:*

DONALD J. QUIGG

*Attesting Officer*

*Commissioner of Patents and Trademarks*